US010745882B1

(12) United States Patent
Clouse

(10) Patent No.: US 10,745,882 B1
(45) Date of Patent: Aug. 18, 2020

(54) SOIL COLLECTION ATTACHMENT WITH AUTOMATED GATE

(71) Applicant: Dakota Fence Company, Fargo, ND (US)

(72) Inventor: Rodney Clouse, Fargo, ND (US)

(73) Assignee: Dakota Fence Company, Fargo, ND (US)

( * ) Notice: Subject to any disclaimer, the term of this patent is extended or adjusted under 35 U.S.C. 154(b) by 211 days.

(21) Appl. No.: 15/466,375

(22) Filed: Mar. 22, 2017

(51) Int. Cl.

| | |
|---|---|
| ***E02F 3/40*** | (2006.01) |
| ***E21B 21/015*** | (2006.01) |
| ***E02F 9/22*** | (2006.01) |
| ***E21B 12/06*** | (2006.01) |
| *E02F 3/32* | (2006.01) |
| *E02F 3/34* | (2006.01) |
| *E02F 9/28* | (2006.01) |

(52) U.S. Cl.
CPC ..... *E02F 3/40* (2013.01); *E02F 9/2271* (2013.01); *E21B 12/06* (2013.01); *E21B 21/015* (2013.01); *E02F 3/32* (2013.01); *E02F 3/3405* (2013.01); *E02F 3/3414* (2013.01); *E02F 9/2833* (2013.01)

(58) Field of Classification Search
CPC ... E02F 3/407; E02F 3/40; E02F 3/401; E02F 3/94; E02F 7/06; E02F 9/2271; E02F 3/32; E02F 3/3414; E02F 3/3405; E02F 9/2833; E21B 12/00; E21B 12/06; E21B 21/015
USPC ..... 37/444, 411, 420, 466, 434, 468, 37/403–409; 172/25
See application file for complete search history.

(56) References Cited

U.S. PATENT DOCUMENTS

| | | | | |
|---|---|---|---|---|
| 2,001,502 | A | 5/1935 | Satre | |
| 3,190,375 | A | 6/1965 | Pearson | |
| 3,422,913 | A | 1/1969 | Young, Jr. | |
| 3,556,232 | A | 1/1971 | Koziski | |
| 3,747,697 | A | 7/1973 | Russell, Jr. | |
| 3,791,464 | A | 2/1974 | Stewart | |
| 3,835,941 | A | 9/1974 | King | |
| 3,894,400 | A | 7/1975 | Stillwell et al. | |
| 3,952,858 | A | 4/1976 | Watts | |
| 4,068,771 | A * | 1/1978 | Zimmerman | E02F 3/40 37/403 |
| 4,148,367 | A | 4/1979 | Reich | |
| 4,672,901 | A | 6/1987 | Stine | |
| 5,004,022 | A * | 4/1991 | Carlsson | B65B 69/0075 141/10 |
| 5,067,569 | A | 11/1991 | Gilcrease | |
| 6,128,852 | A | 10/2000 | Hansen | |
| 6,193,403 | B1 * | 2/2001 | Nystrom | B01F 7/081 366/186 |

(Continued)

FOREIGN PATENT DOCUMENTS

| | | | |
|---|---|---|---|
| CN | 102168528 | A | 8/2011 |
| CN | 103334710 | A | 10/2013 |
| CN | 203675573 | U | 7/2014 |

*Primary Examiner* — Robert E Pezzuto
(74) *Attorney, Agent, or Firm* — Taft Stettinius & Hollister LLP; Audrey J. Babcock

(57) ABSTRACT

A soil collection attachment for movable equipment is described. The soil collection attachment includes a bucket including a bottom panel having an aperture, wherein the aperture is adapted to receive an excavation device such as an auger. A gate which is operated by a hydraulic cylinder is attached to the bottom panel. In a closed position, the gate covers the aperture to prevent excavation materials from falling through the aperture.

15 Claims, 15 Drawing Sheets

(56) References Cited

U.S. PATENT DOCUMENTS

| | | | | |
|---|---|---|---|---|
| 6,718,661 | B1 * | 4/2004 | Miller | E02F 3/962 37/395 |
| 7,849,938 | B1 | 12/2010 | Maier | |
| 8,490,663 | B2 * | 7/2013 | Wright | A01G 3/08 144/4.1 |
| 8,991,512 | B2 * | 3/2015 | George | E21B 12/00 172/25 |
| 9,121,164 | B1 * | 9/2015 | Babiarz | E02F 3/348 |
| 9,151,076 | B2 * | 10/2015 | George | E21B 21/015 |
| 9,309,736 | B2 | 4/2016 | Watson | |
| 10,188,028 | B2 * | 1/2019 | Mihara | A01G 23/04 |
| 2003/0097772 | A1 * | 5/2003 | Christensen | B62B 1/18 37/304 |

* cited by examiner

OPEN TO DRILL

DRILLING

TRANSPORT WITH BUCKET LEVEL

CLOSED FOR TRANSPORT

DUMP COLLECTED DIRT

SOIL COLLECTION ATTACHMENT WITH AUTOMATED GATE

TECHNICAL FIELD

The present invention relates to a soil collection attachment for movable equipment such as skid steer loaders. The attachment is used to collect excavated material, including soil, sand, dirt, and clay, which is displaced from the ground when digging a hole.

BACKGROUND OF THE INVENTION

When using an excavation device such as an auger, shovel, or post hole digger to dig holes in the ground, the excavated material removed from the hole generally settles around the hole. Manual labor must then be used to collect the excavated material and transport it to another location. For example, people must shovel the dirt, sand, soil, or clay that has collected around the hole into a wheel barrow or other device which can transport the excavated material. The wheel barrow must then be pushed to a location where the excavated material may be deposited, such as up a ramp into the bed of a dump truck. Excavated material is then shoveled out of the wheel barrow. This procedure for cleaning up the excavated materials after digging a hole with an excavation device is time-consuming and labor-intensive.

An example of an excavation cleanup device is described in U.S. Patent Application Publication No. 2003/0097772. That patent application describes a collection tray for collecting excavated material removed from a hole during the excavation process. This collection tray includes an aperture through which an auger may be admitted. This aperture remains open after the auger is removed, and remains open when the collection tray is moved to a different location to dispose of the collected excavated material. The collection tray includes handles and a wheel, so that the tray may be pushed in a manner similar to a wheel barrow. U.S. Patent Application Publication No. 2003/0097772 does not disclose a means for closing the aperture in the collection tray, and does not disclose a means for transporting and disposing of the excavated material in an automated manner. It also does not disclose the attachment of a collection tray to movable equipment such as a loader.

Other examples of excavation cleanup devices are described in U.S. Pat. Nos. 8,991,512 and 9,151,076. Those patents also describe trays which include an aperture through which an auger may be admitted. A plate may be used to manually close the aperture by sliding the plate across the aperture after the auger is removed. Handles are included to facilitate the lifting and carrying of the tray. However, those patents do not disclose an automated means for opening or closing the aperture in the collection tray, and do not disclose a means for transporting and disposing of the excavated material in an automated manner. They also do not disclose the attachment of a collection tray to movable equipment such as a loader.

There is a need for a soil collection device including an automated means for opening and closing a gate which covers an aperture in the device. There is also a need for a soil collection device which allows excavated material to be collected and transported in an automated manner without the use of manual labor. Moreover, there is a need for a soil collection device which allows the material excavated from several different holes to be collected prior to transporting the device to another location to dispose of the excavated material.

SUMMARY OF THE INVENTION

The present invention is directed to a soil collection attachment with an automated gate. The soil collection attachment is an attachment for movable equipment. As used herein, the term "movable equipment" encompasses heavy equipment, large equipment, mid-sized equipment, and compact equipment. Examples of "movable equipment" include, but are not limited to, loaders (such as compact loaders, wheel loaders, skid steer loaders, front-end loaders, and articulated loaders), tractors, excavators, backhoes, material handlers, and utility vehicles.

The soil collection attachment includes a bucket that has an aperture in the bottom panel of the bucket. The aperture is sized and shaped so that when the bottom panel of the attachment is placed on the ground, an auger or other excavation device may be admitted into the aperture. When the auger digs a hole in the ground, the excavated materials are deposited in the bucket of the attachment, instead of being deposited on the ground around the hole. As used herein, "excavated material" is material including, but not limited to, soil, sand, dirt, and clay, which is displaced from the ground when digging a hole. The excavated material is contained by, and remains in, the bucket of the attachment until the material is removed. The bucket includes a gate that slides across the aperture after the auger is removed from the ground, thereby closing the aperture so that the excavated material does not fall out of the bucket through the aperture when the excavated material is being transported to another location. The gate is automated. In a preferred embodiment, the gate is operated by a hydraulic cylinder. Therefore, the gate can be open and shut by the operator of the movable equipment using a button or lever, without the need for the operator to leave the operator control area of the movable equipment. The operator control area is the area from which the equipment operator controls the movable equipment. This operator control area may be an enclosed or partially enclosed cab of the movable equipment, or it may be a space on or adjacent to the movable equipment which is not enclosed.

The soil collection attachment may be used to collect excavated material obtained from digging any hole, including holes for fence posts, holes for planting trees, holes excavated to collect soil samples, or holes excavated for any other purpose. The bucket of the soil collection attachment can preferably collect the excavated materials from several holes before the excavated materials need to be removed from the bucket. The soil collection attachment of the present invention greatly reduces the time and labor required to collect and transport excavated material.

In a preferred embodiment, the soil collection attachment, when attached to movable equipment, is able to collect, transport, and dispose of excavated material in an automated manner. The functions of the soil collection attachment may be controlled by the equipment operator, through the operation of controls which are located in the operator control area of the movable equipment. Accordingly, the soil collection attachment allows excavated material to be collected, transported, and disposed of without the need for manual labor.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

FIG. 12A is a top view, FIG. 12B is a side view, and FIG. 12C is a perspective view of the soil collection attachment, with the gate in an open position to receive a drill or auger. FIG. 12D is a side view, and FIG. 12E is a perspective view, of the soil collection attachment with an auger inserted in the aperture of the attachment. FIG. 12F is a side view, FIG. 12G is a top view, and FIG. 12H is a perspective view, of the soil collection attachment including excavated material, with the gate in a closed position. FIG. 12I is a side view of the soil collection attachment and a container for excavated material, wherein the attachment is in a position for depositing the excavated material from the attachment to the container.

DETAILED DESCRIPTION OF THE INVENTION

Figure 1:
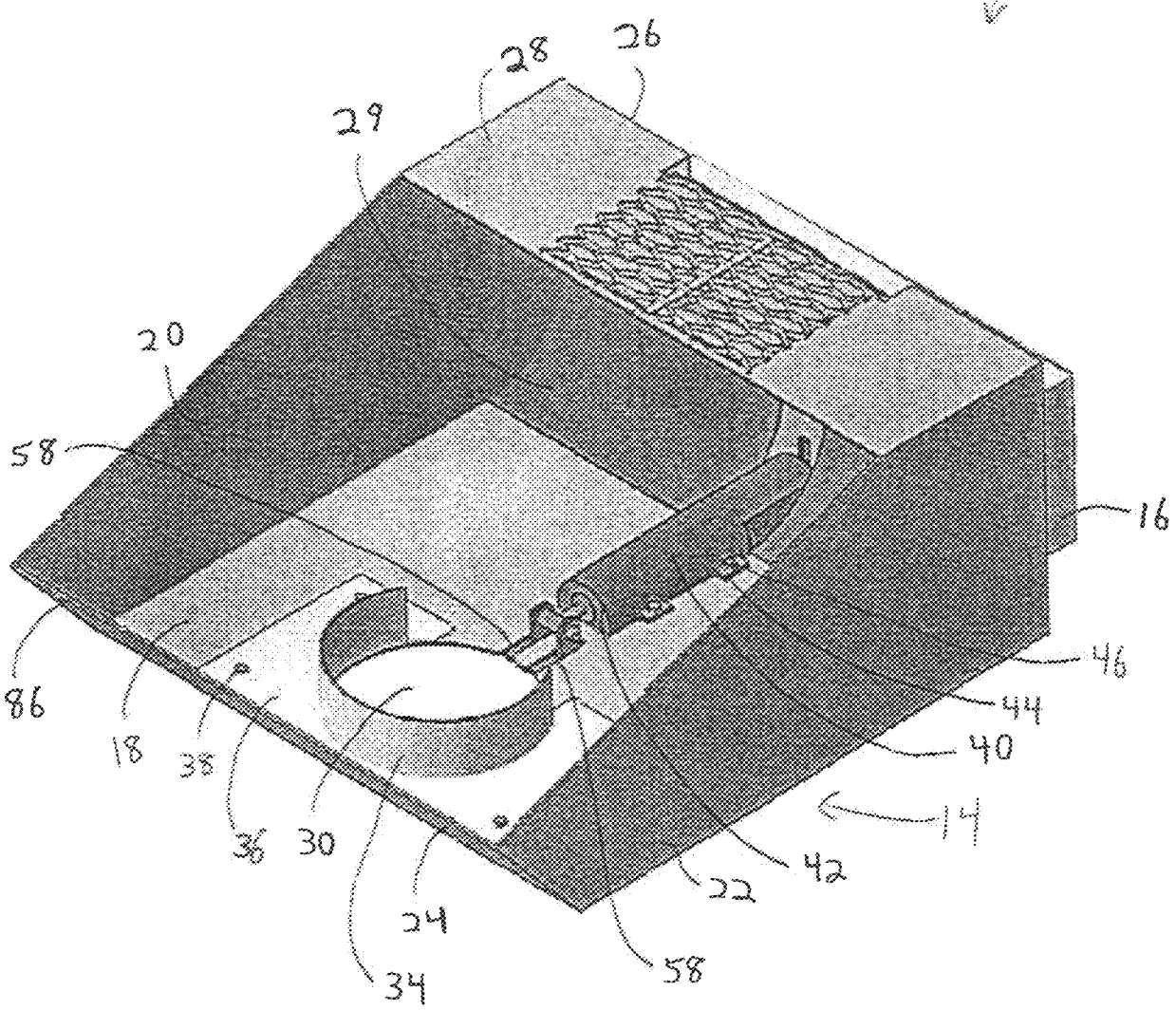
FIG. 1 is a perspective view of a soil collection attachment of the present invention, including a gate in an open position.
Figure 2:
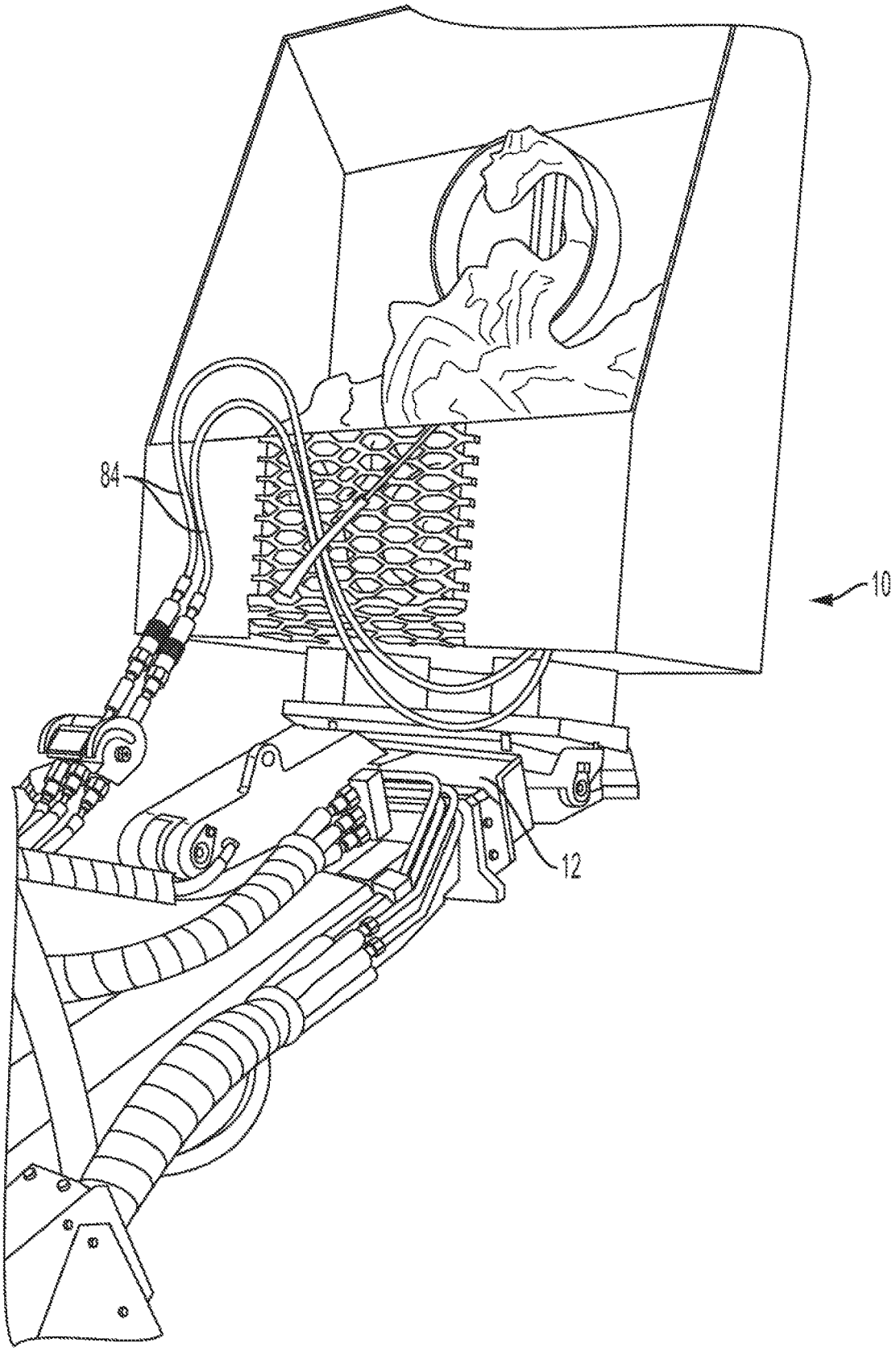
FIG. 2 is a perspective view of the soil collection attachment of FIG. 1 attached to the boom of a loader.

FIG. 1 depicts a soil collection attachment 10. The soil collection attachment 10 is an attachment for movable equipment including, but not limited to, a skid steer loader or a front-end loader. FIG. 2 shows soil collection attachment 10 attached to the boom 12 of a skid steer loader. The soil collection attachment 10 includes a bucket 14 and an attachment plate 16. The bucket 14 includes a bottom panel 18, side panels 20, 22, a front panel 24, a back panel 26, and a top panel 28.

A curved plate 29 may also be included in the bucket 14. The curved plate is positioned in front of back panel 26. Without a curved plate 29, excavated material may collect and become compacted in the joint between bottom panel 18 and back panel 26. By eliminating a 90° angle in the back of bucket 14, the curved plate 29 reduces or eliminates the compaction of the excavated material, and therefore makes it easier for the bucket to be emptied. In locations with wet soil or clay, the curved plate 29 would be more helpful than in locations with dry sand, where soil compaction would not be an issue. The curved plate 29 also strengthens the back of the bucket 14. Specifically, the weight of excavated material can deform the back panel 26 in some cases. However, when a curved plate 29 is included, the curved plate acts as a gusset which strengthens the back of the bucket 14 and prevents back panel 26 from deforming. Therefore, the use of curved plate 29 may allow a lighter material to be used in the construction of back panel 26.

Figure 3:
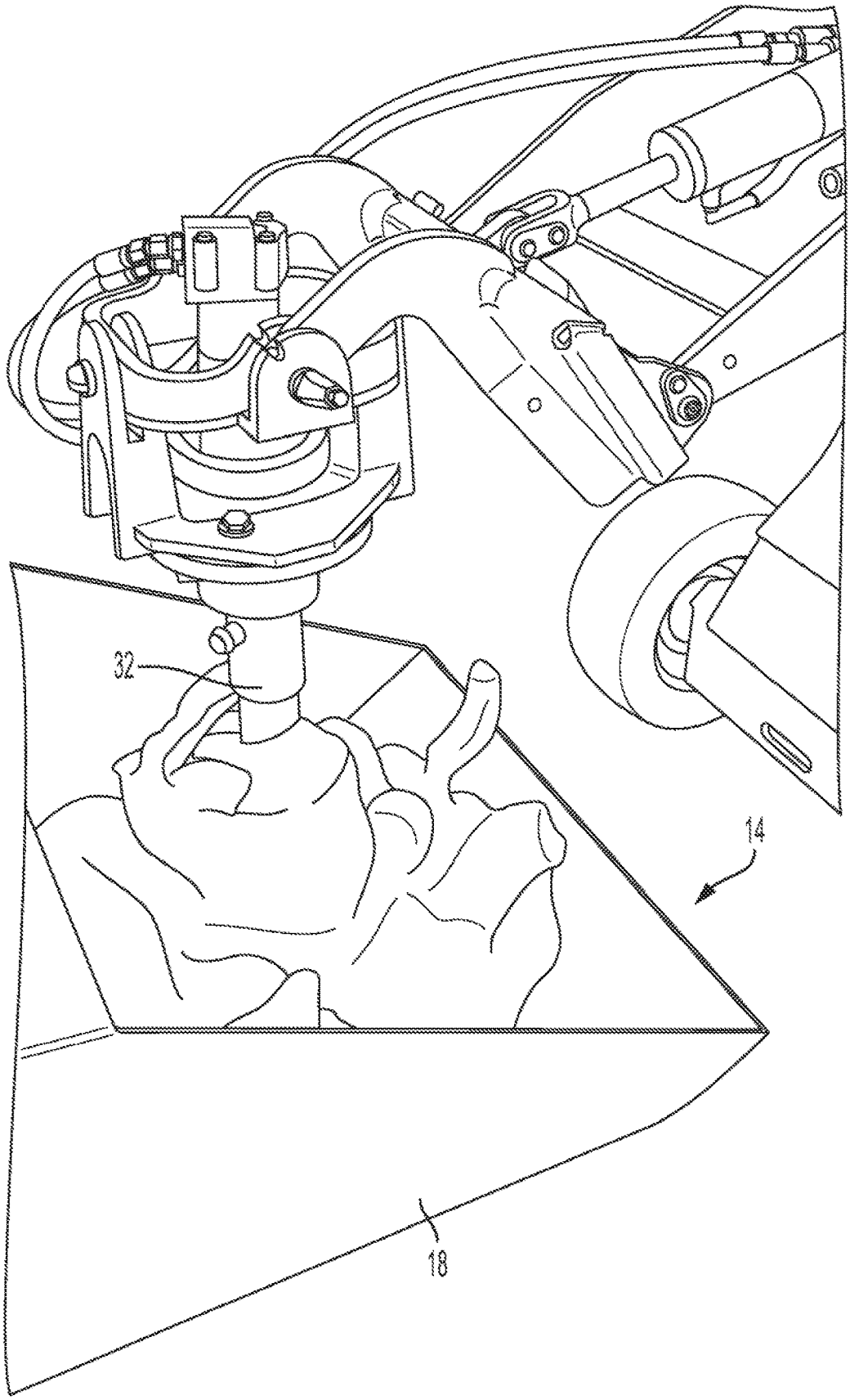
FIG. 3 is a partial perspective view of the bucket of the soil collection attachment of FIG. 1, with an auger positioned through an aperture of the bottom panel of the bucket.

An aperture 30 passes through the bottom panel 18. In the embodiment shown in FIG. 1, the aperture is substantially circular in order to accommodate an auger, but in other embodiments, the aperture may be of a different shape. FIG. 3 shows the bottom panel 18 resting on the ground, with an auger 32 placed in aperture 30, such that auger 32 is substantially perpendicular to bottom panel 18. As shown in FIG. 1, a collar 34 surrounds the aperture 30. A base plate 36 extending from collar 34 is attached to the bottom panel 18. In the embodiment shown, the base plate 36 is attached to the bottom panel 18 by plate fasteners 38. In other embodiments, the base plate 36 may be attached to the bottom panel 18 by other means, such as by welding, soldering, adhesives, or other mechanical fasteners.

A hydraulic cylinder 40 is attached to the back panel 26. Specifically, back panel attachment tabs 45 are secured to back panel 26 (see FIG. 5), and the bottom end 47 of hydraulic cylinder 40 is secured to the back panel attachment tabs. In the embodiment shown, there is an aperture in back panel 26 and curved plate 29 for the hydraulic cylinder 40 to pass through, with the bottom end 47 of the hydraulic cylinder positioned on the opposite side of the back panel 26 from the rod end 54 (see FIG. 4). FIG. 1 shows that the aperture in curved plate 29 which accommodates hydraulic cylinder 40 extends upward toward top panel 28. However, in other embodiments, the aperture in curved plate 29 may be reduced in size to reduce or eliminate the possibility of excavated material sliding through the aperture.

Figure 4:
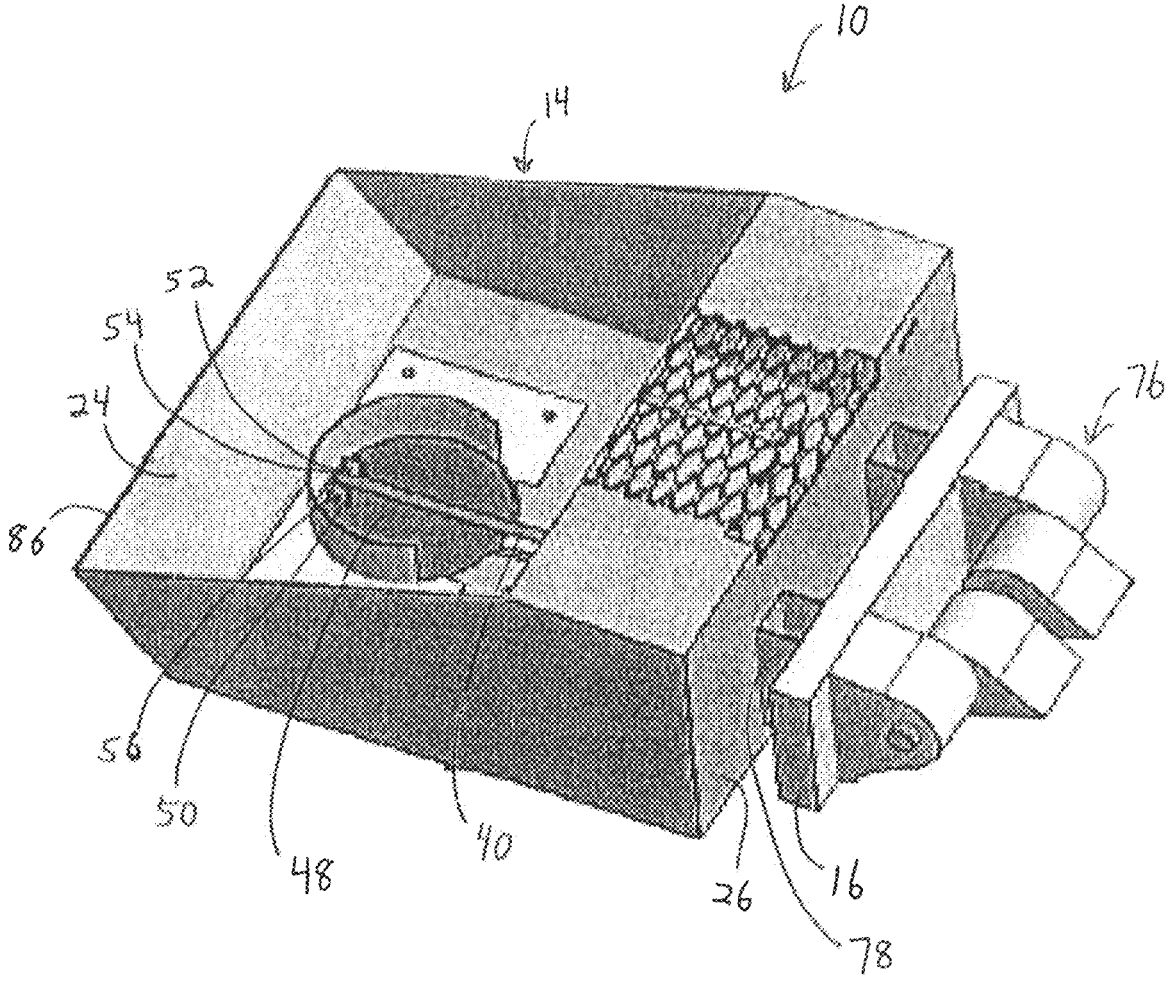
FIG. 4 is a perspective view of the soil collection attachment of FIG. 1, with the gate in a closed position, and an attachment assembly which may be used to attach the soil collection attachment to movable equipment.

As shown in FIG. 1, hydraulic cylinder 40 is covered by cylinder cover 42. Projections 44 extend from cylinder cover 42, and cylinder fasteners 46 pass through apertures in the projections 44 to secure the cylinder cover to the bottom panel 18. The cylinder cover 42 both protects hydraulic cylinder 40, and holds the hydraulic cylinder in place on the bottom panel 18. The hydraulic cylinder 40 is used to open and shut gate 48, which is shown in FIG. 4. Gate 48 comprises a plate that may be used to cover aperture 30. In FIG. 1, the gate 48 is in an open position, with aperture 30 open. In FIG. 4, the gate 48 is in a closed position, with aperture 30 covered. In the embodiment shown in the figures, the gate 48 is moved between the open and closed positions by a sliding action propelled by hydraulic cylinder 40. If excavated material blocks the gate 48 when the hydraulic cylinder 40 is closing the gate, the cylinder cover 42 holds the hydraulic cylinder in place on bottom panel 18; otherwise, the pressure from a blockage in the gate could cause the hydraulic cylinder to lift up off of the bottom panel. Attachment tabs 50 are affixed to gate 48 by an attachment means such as welding, soldering, adhesives, or mechanical fasteners. A locking pin 52 passes through the rod end 54 of hydraulic cylinder 40, and passes through attachment tab apertures 56, thereby connecting hydraulic cylinder 40 to the gate 48. Slots 58 (see FIG. 1) extend through the bottom panel 18, extending from aperture 30. These slots 58 accommodate attachment tabs 50 so that aperture 30 may be completely uncovered when gate 48 is in an open position.

Figure 5:
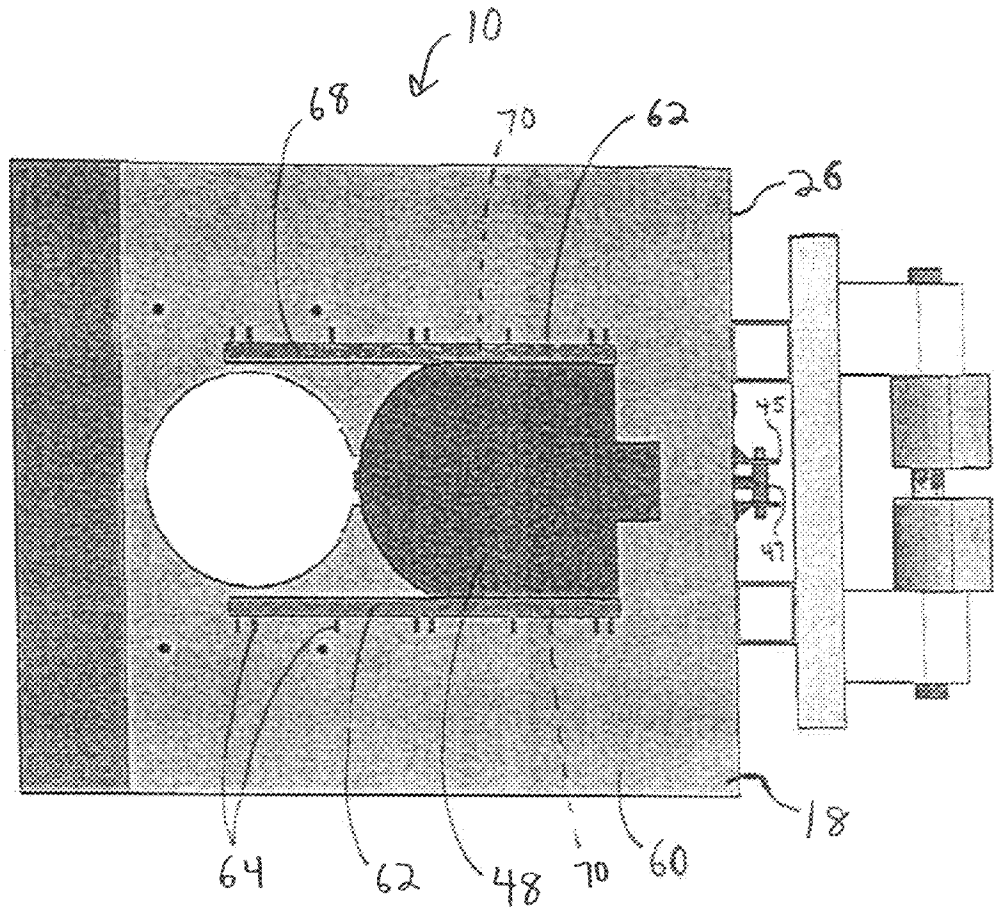
FIG. 5 is a bottom view of the soil collection attachment and attachment assembly of FIG. 4, with the gate in an open position.
Figure 6:
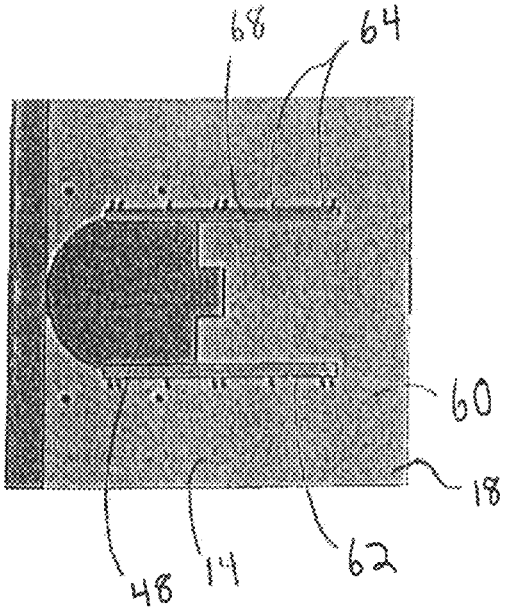
FIG. 6 is a bottom view of the soil collection attachment of FIG. 1, with the gate in a closed position.
Figure 7:
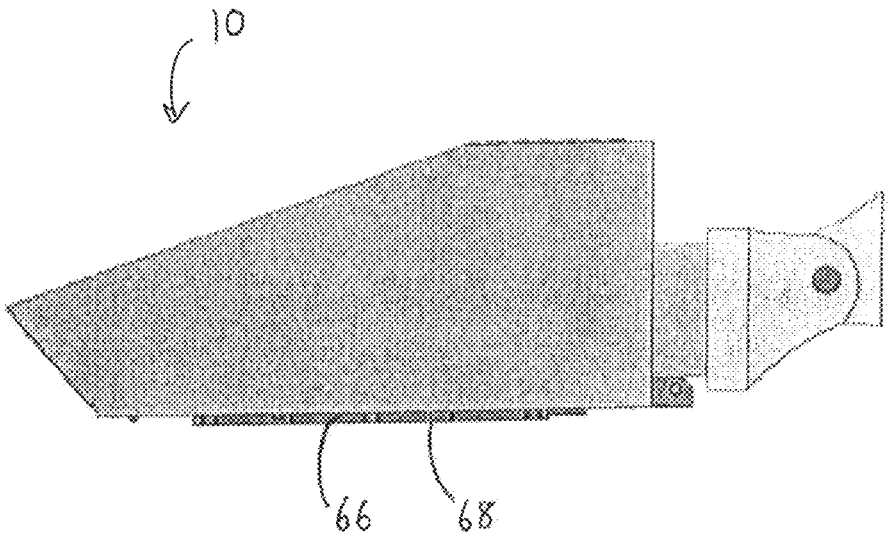
FIG. 7 is a side view of the soil collection attachment and attachment assembly of FIG. 4.

FIG. 5 shows a bottom view of soil collection attachment 10 when gate 48 is in an open position, while FIG. 6 shows a bottom view of the bucket 14 of the soil collection attachment when gate 48 is in a closed position. As shown in FIGS. 5 and 6, the gate 48 contacts, and slides along, the bottom surface 60 of bottom panel 18. Guides 62 are affixed to the bottom surface 60 of bottom panel 18. Guide projections or gussets 64 extend from guides 62. These gussets 64 are attached to the bottom surface 60 of bottom panel 18 by attachment means such as welding, soldering, adhesives, or mechanical fasteners. Guides 62 may also be attached directly to the bottom surface 60 of bottom panel 18 by attachment means such as welding, soldering, adhesives, or mechanical fasteners. Guides 62 each have a guide side panel 66 (see FIG. 7) and a guide bottom panel 68. Each guide side panel 66 extends from the bottom surface 60 of the bottom panel 18 to a guide bottom panel 68, as shown in FIG. 7. Side edges 70 (see FIG. 5) of gate 48 are positioned between the bottom surface 60 of bottom panel 18 and the guide bottom panels 68.

Figure 8:
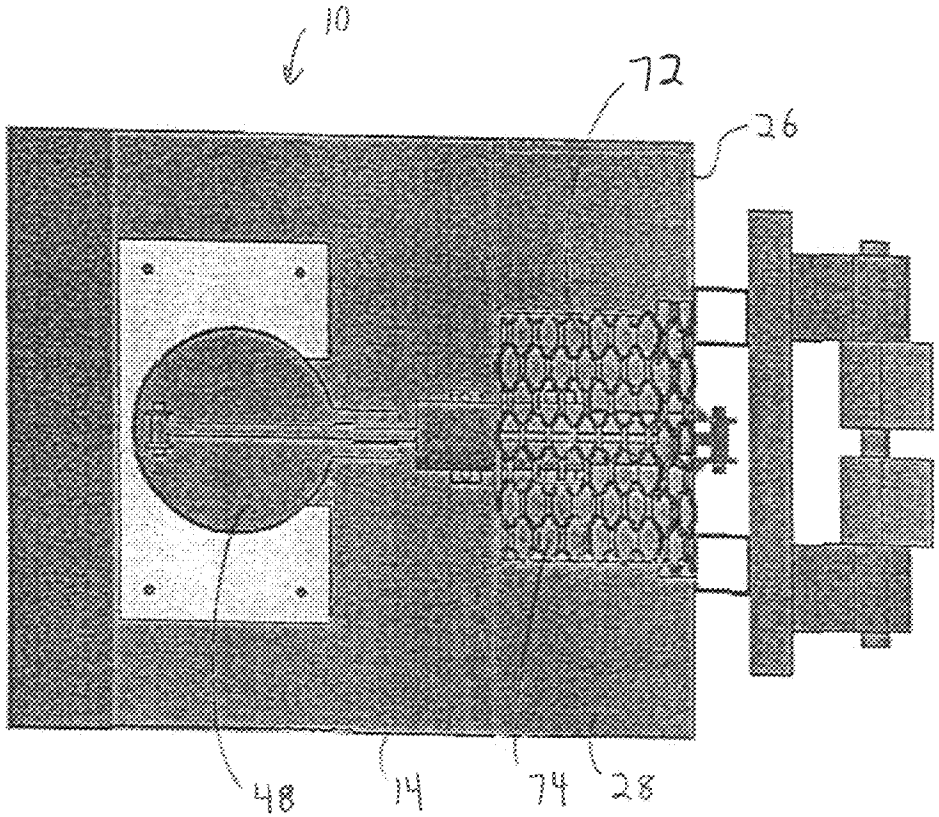
FIG. 8 is a top view of the soil collection attachment and attachment assembly of FIG. 4, with the gate in a closed position.

FIG. 8 shows a top view of soil collection attachment 10 when gate 48 is in a closed position. As shown in FIG. 8, a grate 72 is located in a top panel aperture 74 of top panel 28. The grate 72 facilitates the alignment of aperture 30 with the location where the hole is to be dug in the ground. Specifically, before the digging begins, a mark (such as an "X") can be placed or drawn on the ground to show the planned location for the hole. With the gate 48 open, the equipment operator can look through the grate 72 and aperture 30 to see the mark on the ground, and therefore align aperture 30 with the mark when lowering bucket 14 onto the ground. The bucket 14 can also be moved along the ground by the equipment operator, if necessary to position the aperture 30 around the mark on the ground. Therefore, because of the view of the aperture 30 provided by grate 72, the bucket 14 can be accurately positioned by the equipment operator such that the aperture is in the correct location for digging the hole, without the need for a second person to direct the positioning of the bucket. Grate 72 also allows an operator to see the level of the excavated material in bucket 14 when the bucket is tilted such that back panel 26 is substantially parallel to the ground.

In order to connect bucket 14 to movable equipment, the soil attachment assembly 10 includes an attachment plate 16. The attachment plate 16 is connected to bucket 14 because the attachment plate is secured to attachment connecting plates 78, which are secured to back panel 26. Various attachment assemblies may be used to attach soil collection attachment 10 to movable equipment such as a skid steer loader. Preferably, the attachment plate 16 of the soil collection attachment 10 may be used with standardized attachment assemblies, so that the soil collection attachment may be attached to a variety of types and brands of movable equipment. In the embodiment shown (see FIG. 11), the attachment assembly 76 is a standardized attachment assembly, which includes attachment ears 80 and pivot pin 82. A connection plate 81 is also part of attachment assembly 76, and fits within attachment plate 16 of the soil collection attachment 10. Attachment plate 16 has a hollow space that is sized to receive the connection plate 81. Attachment ears 80 extend from connection plate 81, and pivot pin 82 extends through the attachment ears. When soil collection attachment 10 is attached to movable equipment, pivot pin 82 also extends through apertures on the equipment, such as apertures at the ends of the booms 12 or arms of loaders, as shown in FIG. 2. In the embodiment shown in FIG. 11, the pivot pin 82 extends through movable equipment connections 92. The movable equipment connections 92 are part of the movable equipment, and allow the degree of tilt of the bottom panel 18 to be controlled by the equipment operator.

Hydraulic tubing 84 extends from the hydraulic cylinder 40 to the movable equipment so that the equipment operator can operate the hydraulic cylinder, thereby opening and closing gate 48, without leaving the operator control area of the movable equipment.

In one embodiment, each side of the bottom panel 18 is approximately 41 inches long, and the aperture 30 is approximately 13 inches in diameter. The back panel 26 is approximately 20 inches high, and the top panel 28 is approximately 14 inches long. With such dimensions, 4-5 holes for fence posts, as an example, can be dug using a 12-inch diameter auger before the excavated material needs to be dumped out of the bucket 14. In one embodiment, the angle between the bottom panel 18 and the front panel 24 is approximately 135°, and the front panel is approximately 11 inches wide (i.e. the front panel extends approximately 11 inches from the bottom panel). However, because the front panel 24 is angled, the distance between the top edge 86 of the front panel and the ground, if the bottom panel 18 is resting flat on level ground, is approximately 8 inches. These dimensions allow the excavated material to be emptied out of the bucket 14 by tilting the bucket forward past parallel so that excavated material slides along the front panel 24 and over the top edge 86.

The above dimensions also allow the soil collection attachment 10 to be supported by a skid steer loader or other movable equipment that may be driven on a yard without disturbing or impregnating the soil. Using wide turf-friendly tires and articulating vehicles further reduces the risk of marring a yard when using the soil collection attachment 10 in conjunction with a skid steer loader. In some embodiments in which the dimensions are greater than those provided above, heavier equipment may be needed to support the soil collection attachment 10. In some cases, such as when soil collection attachments 10 are used near people's homes, the use of heavier equipment is not desirable due to the risk of damage to the yard, size limitations, and safety.

However, the above dimensions are provided as an example. In other embodiments, different dimensions may be used. For example, each side of the bottom panel 18 may have a length ranging from about 20 to 60 inches, from about 30 to 50 inches, or from about 35 to 45 inches. The sides of the bottom panel 18 need not each be of equal length. The back panel 26 may have a height ranging from about 5 to 50 inches, from about 10 to 40 inches, or from about 15 to 30 inches. The top panel 28 may have a length ranging from about 5 to 50 inches, from about 7 to 30 inches, or from about 10 to 20 inches. The front panel 24 may have a width ranging from about 1 to 30 inches, from about 5 to 25 inches, or from about 10 to 20 inches. The angle between the bottom panel 18 and the front panel 24 is preferably greater than 90°, and may be from about 105° to 165°, from about 115° to 155°, or from about 125° to 145°. The use of different dimensions will affect the amount of material that may be held by the bucket 14. Also, the use of different dimensions may change the type of movable equipment that is needed to support the soil collection attachment 10.

The aperture 30 of bottom panel 18 may be of different diameters, depending on the cross-sectional diameter of the auger that may be used. Preferably, the diameter of the aperture is about 1 to 2 inches greater than the diameter of the auger. Therefore, if an auger 32 that is 12 inches in diameter is used, then the diameter of the aperture 30 is preferably about 13 to 14 inches. If an auger 32 that is 8 inches in diameter is used, then the diameter of the aperture 30 is preferably about 9 to 10 inches.

Figure 9:
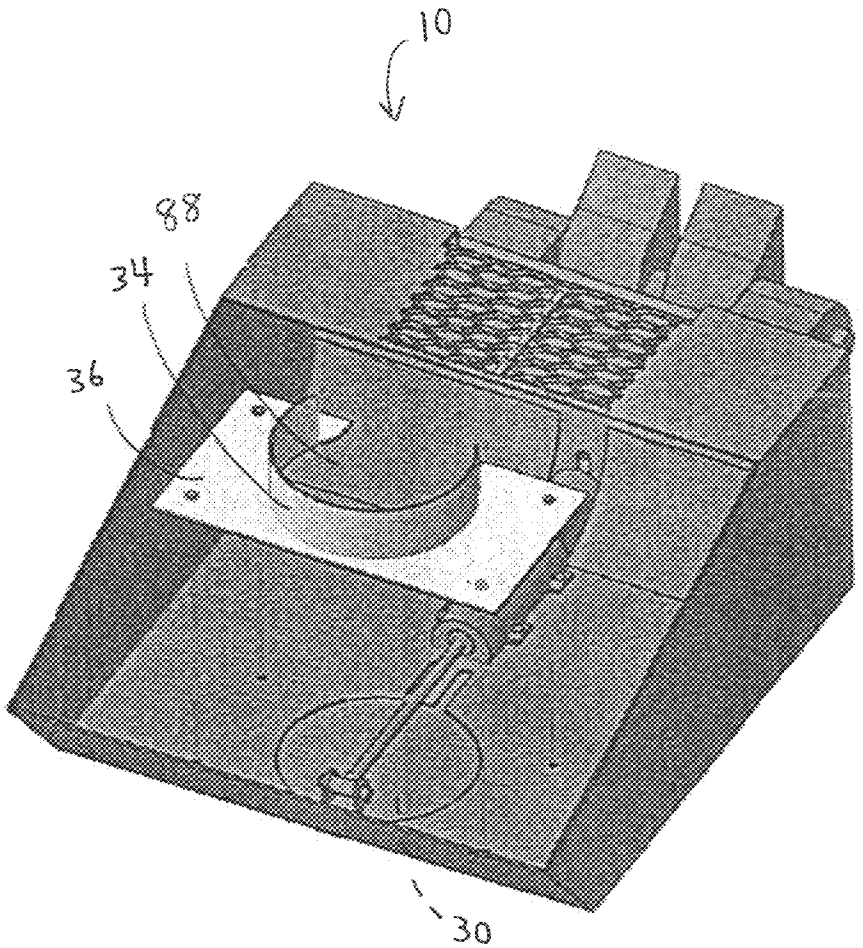
FIG. 9 is a partially exploded perspective view of the soil collection attachment and attachment assembly of FIG. 4, in which the base plate and collar are shown apart from the bottom panel.

In the embodiment of FIG. 1, a collar 34 with a base plate 36 is secured to the base of bottom panel 18. In this embodiment, the collar 34 and base plate 36 are sized so that the collar 34 surrounds aperture 30 without obstructing aperture 30. However, in some embodiments, the base plate aperture 88 (see FIG. 9) has a diameter which is smaller than the diameter of the aperture 30. In such embodiments, the effective diameter of aperture 30 is decreased, because part of the aperture 30 is covered by base plate 36. Using a base plate 36 having a base plate aperture 88 with a smaller diameter than aperture 30 is helpful when a smaller auger 32 is to be used. For example, if aperture 30 is 14 inches in diameter, the bucket 14 will work well to collect material excavated by an auger 32 that is 13 inches in diameter. However, if the auger 32 is 8 inches in diameter and the aperture 30 is 14 inches in diameter, some material excavated by the auger may fall on the ground between aperture 30 and the hole dug by the auger, instead of falling into the bucket 14. Instead of allowing that to happen, a base plate 36 with a base plate aperture 88 of a diameter of approximately 9 inches could be attached to bottom panel 18, so that the base plate 36 would more closely surround the auger 32 than the bottom panel 18 would, and therefore the bucket 14 would collect more excavated material. Base plates 36 with a variety of different base plate apertures 88 may be available, so that different base plates may be used depending on the diameter of the hole to be excavated. For example, a plurality of base plates 36 having different base plate apertures 88 may be provided with the soil collection attachment 10. Guides may be attached to bottom panel 18, or to side panels 20, 22, so that base plates 36 may be slid in and out of bucket 14 and held in place by the guides. Alternatively, base plates 36 may be removably attached to the bottom panel by plate fasteners 38, which may include threaded fasteners or other mechanical fasteners. In some embodiments, a base plate 36 may be included without collar 34. In other embodiments, neither a base plate 36 nor a collar 34 may be included as part of soil collection attachment 10, or they may be included with the soil collection attachment 10 as optional components which may be attached to the soil collection attachment by the user.

In other embodiments, the collar 34 may be used without base plate 36. In that case, the collar 34 may be affixed to the bottom panel 18 by attachment means such as soldering, welding, or adhesives, or by including a flange which may be attached to the bottom panel by mechanical fasteners.

Figure 10:
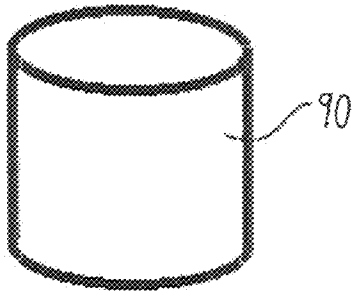
FIG. 10 is a perspective view of a detachable tube which may be used in conjunction with the soil collection attachment of FIG. 1.
Figure 11:
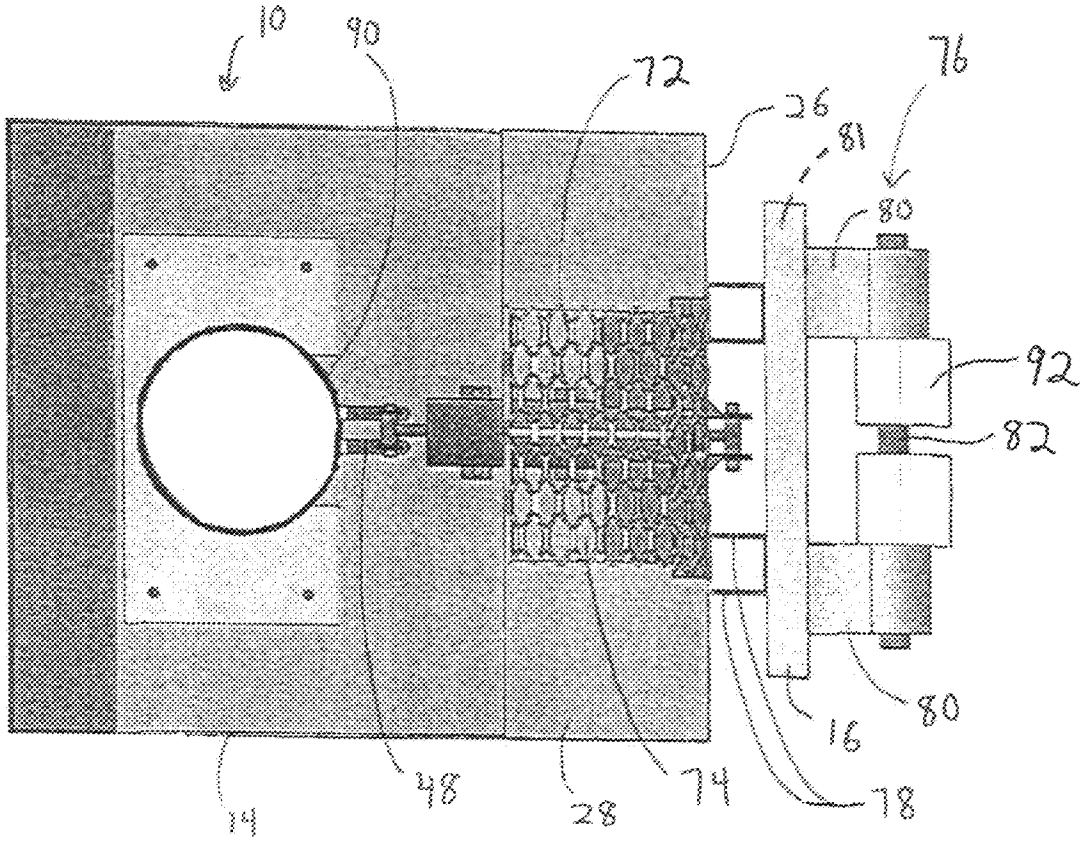
FIG. 11 is a top view of the soil collection attachment of FIG. 1 to which a detachable tube has been added.

The height of the collar 34 may range from about 0.5 inch to about 12 inches, from about 2 inches to about 10 inches, or from about 4 inches to about 8 inches. A detachable tube 90, shown in FIG. 10, may also be used, in place of or in conjunction with collar 34, to surround the aperture 30 and help prevent excavated material from sliding back into the hole before the gate 48 is shut. A detachable tube 90 would be especially helpful when excavating fine particulate soil or sand, to help prevent the soil from the blades of the auger 32 from falling into the hole before the gate 48 is closed. The diameter of the detachable tube 90 is preferably sufficient to closely surround the aperture 30 without leaving space between the aperture and detachable tube. A top view of soil collection attachment 10 including detachable tube 90 is shown in FIG. 11. The height of the detachable tube 90 may range from about 0.5 inch to about 12 inches, from about 2 inches to about 10 inches, or from about 4 inches to about 8 inches. A plurality of detachable tubes 90 of different diameters may be provided, so that if various base plates 36 having base plate apertures 88 of different diameters are provided, a detachable tube with a diameter corresponding with each base plate aperture diameter is available.

When in use, the soil collection attachment 10 is used as an attachment to movable equipment, such as a skid steer loader or a front-end loader. The attachment plate 16 of the soil collection attachment 10 may be attached to a boom 12 of a skid steer loader, as shown in FIG. 2. Prior to an excavation, such as digging a hole in the ground for a fence post, the bucket 14 of the soil collection attachment 10 is lowered onto the ground by the equipment operator, such that the bottom surface of the bottom panel 18 rests on the ground as shown in FIG. 3. The gate 48 in the bottom panel 18 may be opened prior to or after the bucket 14 is lowered onto the ground. The gate 48 may be hydraulically controlled, and therefore may be opened by the equipment operator using a button, lever, or switch located in the operator control area.

Figures 12A, 12B, 12C, 12D, 12E, 12F, 12G, 12H, 12I:
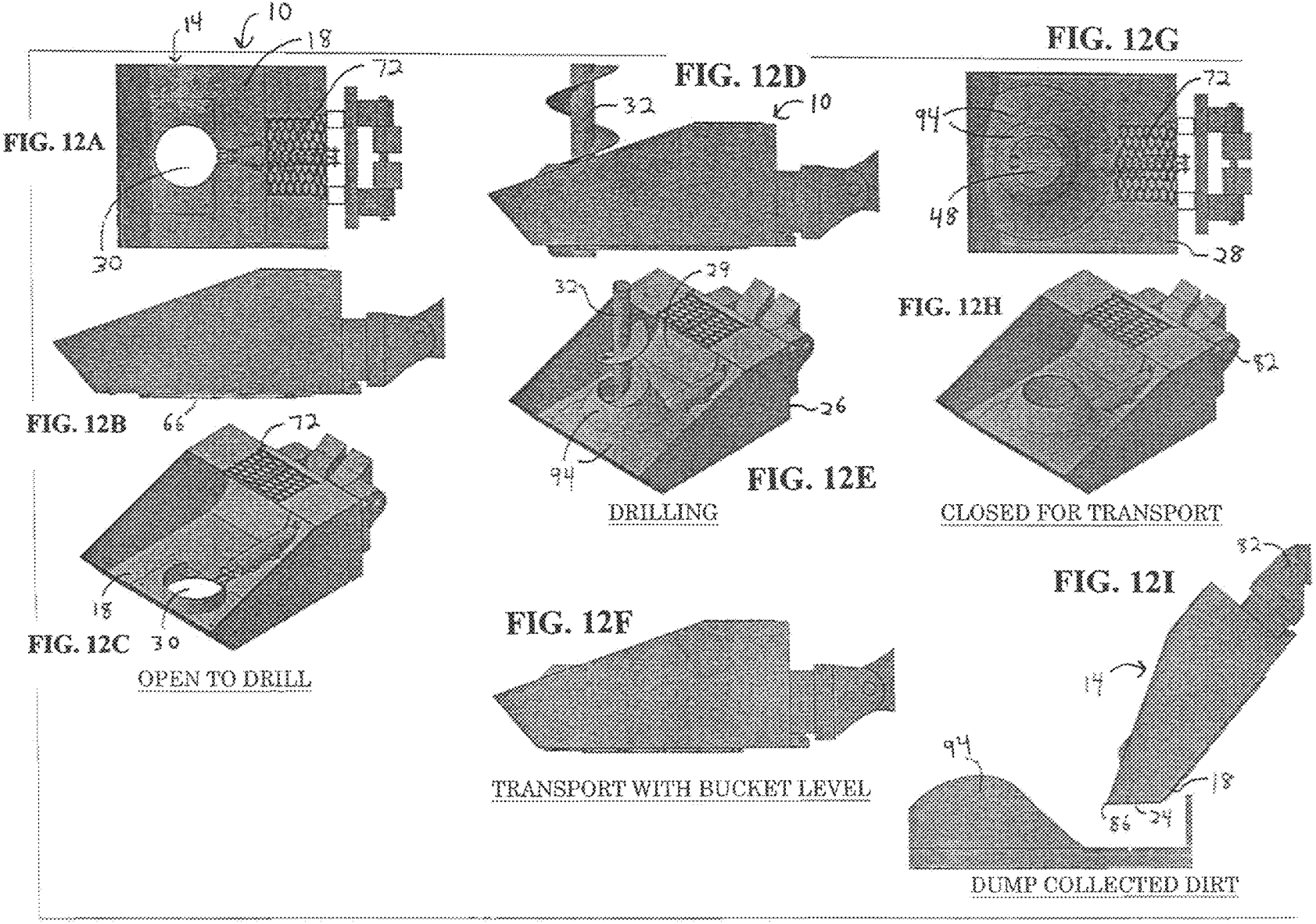
FIGS. 12A-12I depict the use of the soil collection attachment and attachment assembly of FIG. 4.

FIGS. 12A-12C show the soil collection attachment 10 when the gate 48 is open. After the gate 48 is opened, an excavation device such as an auger is lowered onto the ground in the space defined by the aperture 30 in the bottom panel 18 of the bucket 14. The auger 32 or other excavation device may then be used to dig a hole in the ground, as shown in FIG. 3 and FIGS. 12D-12E. FIGS. 3, 12D, and 12E show the soil collection attachment when an auger has been positioned through the aperture of the attachment. As the auger 32 digs a hole, it brings the excavated material 94 above the surface of the ground, as shown in FIGS. 3 and 12E. In the absence of soil collection attachment 10, the excavated materials would simply collect on the ground surrounding the hole, to be removed later by manual labor, or the excavated materials would fall back into the hole. However, when the soil collection attachment 10 is used, the excavated material 94 collects in the bucket 14. After the auger 32 has bored the hole in the ground and the auger has been raised above the ground, the gate 48 in the bottom panel 18 is closed. It may be hydraulically closed by the equipment operator using controls located in the operator control area, which may be a vehicle cab. The gate 48 is closed when the auger 32 has been raised above the ground, as shown in FIGS. 12F-12H, in order to prevent excavated material 94 which has collected in the bucket 14 from sliding back into the hole or onto ground surrounding the hole.

Some excavated materials 94 will slide easily off of the blades of the auger 32 when the auger blades are above ground. In some soil conditions, it is helpful to spin the shaft of the auger 32 when it is above ground, so that excavated materials 94 which have collected on the auger blades will spin off of the blades. The auger 32 may be held over the bucket 14 of the soil collection attachment 10 when excavated materials 94 fall off, or are spun off, of the auger blades, in order to collect the additional excavated materials in the bucket.

After a hole has been bored in the ground and the gate 48 has been closed, the bucket 14 may be lifted off of the ground by lifting the boom 12 of the movable equipment. The bucket 14 may also be lifted slightly off of the ground before shutting the gate 48, so that the gate 48 can be closed more easily. The bucket 14 may then be tilted on the axis of the pivot pin 82, such that the bottom panel 18 is roughly perpendicular to the ground, as shown in FIG. 2. The tilting of the bucket 14, like the operation of gate 48, may be hydraulically controlled using controls located in the operator control area of the movable equipment.

Tilting the bucket 14 as shown in FIG. 2, so that bottom panel 18 is substantially perpendicular to the ground, allows excavated material to slide from the bottom panel 18 to the back panel 26. Moving excavated material away from gate 48 in this manner makes it possible to use the soil collection attachment 10 to collect the excavated materials from more than one hole without emptying the bucket. In other words, after tilting the bucket 14 as shown in FIG. 2, the bucket may be placed on the ground again at a separate location, and the excavation process shown in FIG. 3 may be repeated. In preferred embodiments, holes for several fence posts, such as four or five fence posts of approximately 12 inches in diameter, may be dug before excavated material must be emptied from the bucket 14.

Figure 13:
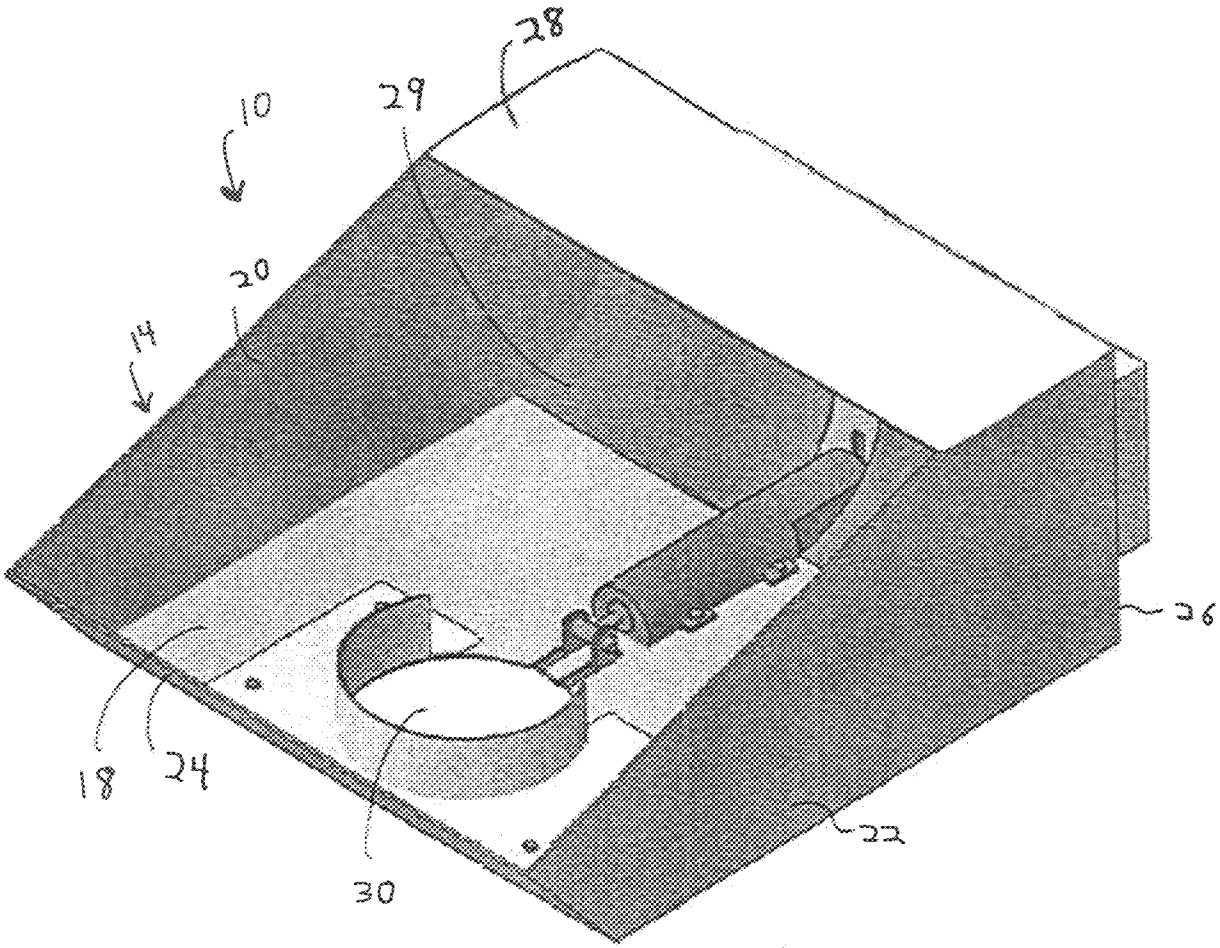
FIG. 13 is a perspective view of a second embodiment of the soil collection attachment of the present invention.

The equipment operator may monitor the amount of excavated material which is being collected in the bucket 14, by looking through grate 72 to observe the level of excavated material when the bucket is in the position shown in FIG. 2. When the excavated material is largely composed of clay or clumpy dirt, the excavated material generally does not fall through the grate 72. However, in geographic locations where the excavated material is composed of fine particulates, it may be preferable not to include grate 72 in the bucket 14, in order to avoid the loss of excavated material through apertures in the grate. If a grate 72 is not included, the top panel 28 may be composed of a solid plate without an aperture. An embodiment of a soil collection attachment 10 in which the top panel 28 is a solid plate is shown in FIG. 13.

Figure 14:
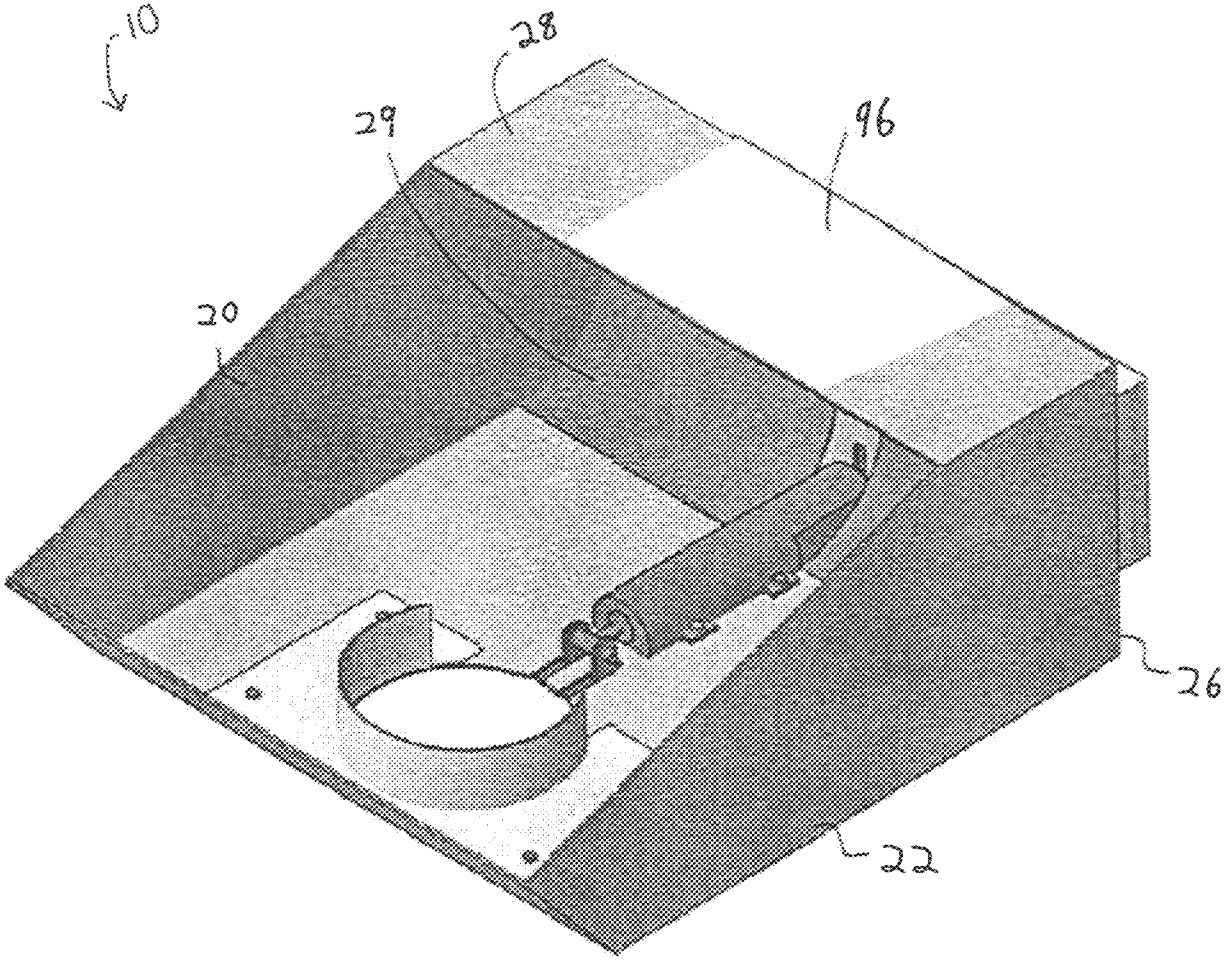
FIG. 14 is a perspective view of a second embodiment of the soil collection attachment of the present invention, including a solid plate panel.

As shown in FIG. 14, a solid plate panel 96 may also be used to cover the grate 72, so that the soil collection attachment 10 may be used with or without an exposed grate, depending on the soil composition. In one embodiment, the bucket 14 may be adapted to include guides on the top panel 28, or on the side panels 20,22 adjacent to the top panel 28, so that a solid plate panel 96 may be slid into place, and held in place, adjacent to the top panel. Alternatively, the solid plate panel 96 may be attached to the top panel 28 using attachment means such as clamps or other mechanical fasteners. The solid plate panel 96 may also be attached to the top panel 28 using other attachment means such as welding, soldering, or adhesives. However, the solid plate panel 96 is preferably attached to the top panel 28 in a reversible manner, so that the soil collection attachment 10 may be used without a solid plate panel (i.e. with an exposed grate), or with a solid plate panel (i.e. without an exposed grate), depending on the soil conditions. In the embodiment shown in FIG. 14, the solid plate panel 96 has a sufficient length to cover grate 72. In other embodiments, the solid plate panel 96 may be longer. For example, solid plate panel 96 may have a sufficient length to extend across the entire length of top panel 28.

Figure 15:
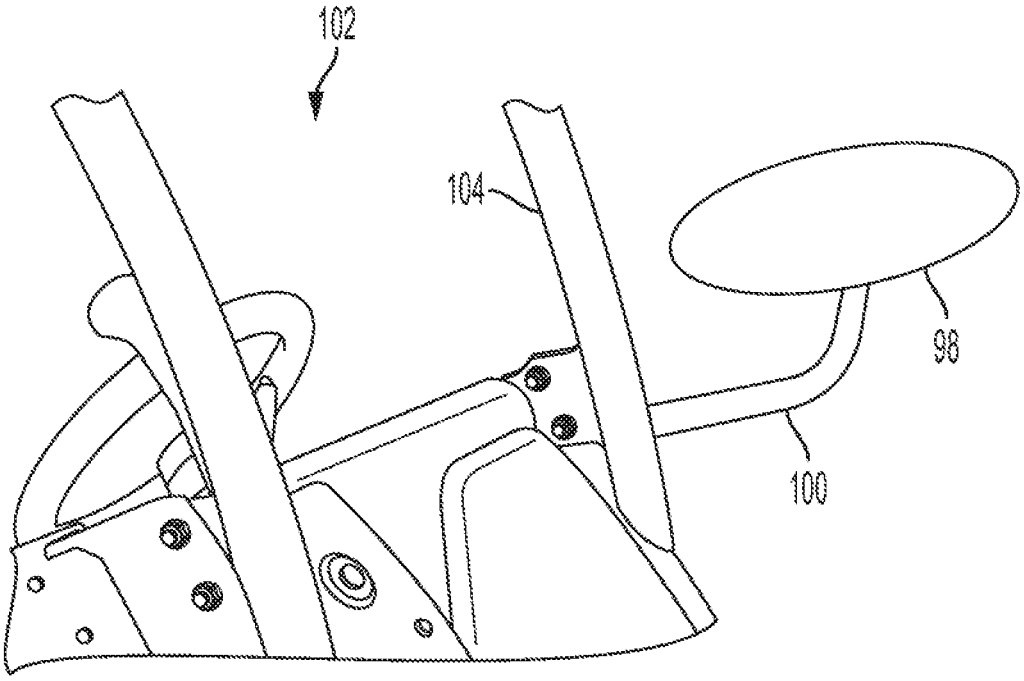
FIG. 15 is a perspective view of a portion of an operator control area of movable equipment which may be used in conjunction with the soil collection attachment of the present invention.

In embodiments of the soil collection attachment 10 which do not include a grate 72, and in embodiments including a grate when the grate is covered by a solid plate panel 96, it is still desirable for the equipment operator to be able to see at least part of the bottom panel 18, and to see through aperture 30. When the operator can see through the aperture 30, the operator can place the aperture so that it surrounds a point marked on the ground to indicate the intended location of the hole. Also, if the operator can see the bottom panel, then the operator can see when there is excavated material on the gate 48, after the bucket 14 is tilted to slide the excavated material to the back panel 26. If enough excavated material has been collected so that material rests on gate 48 even after the bucket 14 has been tilted in that manner, material should be emptied from the bucket before further holes are excavated. Therefore, in order to facilitate the placement of the aperture 30 on the desired location on the ground, and in order to monitor the excavated material, a mirror 98, such as a convex mirror, which is visible to the equipment operator and directed toward the aperture 30 may be mounted on an arm 100 attached to the movable equipment. FIG. 15 shows a portion of an operator control area 102 of movable equipment. In the embodiment shown in FIG. 15, the arm 100 is attached to a support 104 of the operator control area 102. However, in other embodiments, the arm 100 attached to mirror 98 may be attached to other components of the movable equipment. In some embodiments, instead of including an arm 100, the mirror 98 may be attached to directly to the movable equipment. Alternatively, mirror 98 may be mounted on the soil collection attachment 10, such as on a side panel 20,22, the front panel 24, or the collar 34. Mirror 98 may also be attached to an arm 100 which is mounted on the soil collection attachment 10, such as on a side panel 20,22, the front panel 24, or the collar 34. When a mirror 98 is used, the equipment operator can watch the reflection in the mirror to observe when the aperture 30 is at the correct location on the ground. The equipment operator can also use the mirror 98 to observe when there is excavated material on the gate 48, and therefore the equipment operator will know when the bucket 14 must be emptied. Mirror 98, or arm 100, may be secured to the movable equipment or to the soil collection attachment by an attachment means such as welding, soldering, adhesives, or mechanical fasteners.

Modifications to the soil collection attachment 10, such as including a grate 72 when the attachment will be used in the excavation of clay, and including a mirror 98 instead of a grate when the attachment will be used in the excavation of fine particulate soil, allow the attachment to be adapted to different terrains. Alternatively, the soil collection attachment 10 may include a grate 72, and may be provided with a solid plate panel 96 and a mirror 98, so that the solid plate panel may be used to cover the grate when needed. In circumstances when grate 72 is covered with the solid plate panel 96, mirror 98 may be attached to the movable equipment or to the soil collection attachment 10. Arm 100 may also be provided with soil collection attachment 10, with the arm either attached or attachable to mirror 98.

To transport the excavated material 94 to a location where the excavated material may be emptied out of bucket 14, the movable equipment may be driven to another location. The bottom panel 18 may be substantially parallel with the ground when the movable equipment is driven to another location, and indicated in FIG. 12F. When the movable equipment is at a location where the excavated material may be removed, the bucket 14 may be tilted forward, as shown in FIG. 12I, such that the front panel 24 is sloped with the top edge 86 pointed toward the ground. In other words, the bucket 14 is generally tilted in the opposite directed from the direction in which it is positioned in FIG. 2. This allows excavated material to slide out of the bucket 14 by sliding across front panel 24 and over top edge 86. The excavated material 94 may, for example, be deposited into a dump truck in this manner. The angle between bottom panel 18 and front panel 24 is designed to allow the bucket 14 to be emptied by gravity, instead of by the use of manual labor.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A soil collection attachment comprising:

a bucket including a bottom panel having an aperture, a gate slidably attached to the bottom panel, a top panel substantially parallel to the bottom panel, and a hydraulic cylinder, wherein the hydraulic cylinder is adapted to move the gate between a closed position and an open position, and wherein the aperture is adapted to receive an excavation device; and an attachment plate secured to the bucket, wherein the attachment plate is adapted to connect the bucket to movable equipment, wherein the top panel includes a top panel aperture, and a grate is located in the top panel aperture.

2. The soil collection attachment of claim 1, the bucket further comprising a front panel, a back panel, and a side panel.

3. The soil collection attachment of claim 2, wherein the angle between the front panel and the bottom panel is greater than 90°.

4. The soil collection attachment of claim 2, wherein the angle between the front panel and the bottom panel is less than 90°.

5. The soil collection attachment of claim 1, further comprising a collar surrounding at least a portion of the aperture.

6. The soil collection attachment of claim 1, further comprising a base plate secured to the bottom panel.

7. The soil collection attachment of claim 6, the base plate having a base plate aperture, wherein a diameter of the base plate aperture is smaller than a diameter of the aperture of the bottom panel.

8. The soil collection attachment of claim 1, further comprising a detachable tube, wherein an end of the detachable tube surrounds the aperture.

9. The soil collection attachment of claim 1, wherein at least a portion of the hydraulic cylinder is located on a top surface of the bottom panel, and the gate is attached to a bottom surface of the bottom panel.

10. A kit comprising:

the soil collection attachment of claim 1; and a plurality of base plates, wherein a first base plate of the plurality of base plates has a first base plate aperture, and a second base plate of the plurality of base plates has a second base plate aperture, and wherein a diameter of the first base plate aperture and a diameter of the second base plate aperture are each smaller than a diameter of the aperture of the bottom panel.

11. A kit comprising:

the soil collection attachment of claim 1;

a solid plate panel adapted to cover the grate in the top panel aperture; and a mirror.

12. The kit of claim 11, further comprising an arm secured to the mirror.

13. A method of excavating a hole, comprising:

attaching the soil collection attachment of claim 1 to the movable equipment;

placing a mark on a location on the ground;

moving the gate of the soil collection attachment into the open position using the hydraulic cylinder;

placing the bucket of the soil collection attachment onto the ground, using controls in an operator control area of the movable equipment, such that the mark on the location on the ground is located within the aperture;

inserting an excavation device into the aperture;

digging the hole in the ground using the excavation device, such that the excavation device brings excavated material above the ground;

collecting the excavated material in the bucket while digging the hole in the ground;

removing the excavation device from the aperture;

moving the gate into the closed position using the hydraulic cylinder;

lifting the bucket above the ground, using the controls in the operator control area;

driving the movable equipment to a location for receiving the excavated material; and tilting the bucket using the controls in the operator control area, such that the excavated material slides out of the bucket.

14. The method of claim 13, wherein the step of placing the bucket of the soil collection attachment onto the ground includes looking through the grate and the aperture to locate the mark on the ground.

15. The method of claim 13, wherein the movable equipment or the soil collection attachment includes a mirror; and wherein the step of placing the bucket of the soil collection attachment onto the ground includes looking at a reflection of the aperture in the mirror to locate the mark on the ground.

* * * * *